United States Patent [19]

Souza et al.

[11] 4,328,758

[45] May 11, 1982

[54] THREAD END HOLDER FOR SEWING MACHINE

[75] Inventors: Ronald Souza, Westport, Mass.; Owen F. Dunne, Tiverton, R.I.

[73] Assignee: Clevepak Corporation, White Plains, N.Y.

[21] Appl. No.: 76,438

[22] Filed: Sep. 17, 1979

[51] Int. Cl.[3] ..... D05B 65/06

[52] U.S. Cl. ..... 112/286; 112/287; 112/262.1; 112/235; 112/DIG. 3

[58] Field of Search ..... 112/286, 287, 282, 262.1, 112/264.1, 265.1, 65, 67, 69, DIG. 2, DIG. 3, 235, 240, 110

[56] References Cited

U.S. PATENT DOCUMENTS

| | | | |
|---|---|---|---|
| 3,320,911 | 5/1967 | Ketterer | 112/262.1 X |
| 3,340,838 | 9/1967 | Morris | 112/262.1 |
| 3,371,632 | 3/1968 | Snyder et al. | 112/65 X |
| 3,690,276 | 9/1972 | King et al. | 112/287 |
| 4,149,478 | 4/1979 | Sanvito | 112/286 |

*Primary Examiner*—Peter P. Nerbun

*Attorney, Agent, or Firm*—Senniger, Powers, Leavitt and Roedel

[57] ABSTRACT

An apparatus and method in which loose thread ends are drawn by air flow into a tube adjacent the needle of a sewing machine, at least between sewing operations.

16 Claims, 3 Drawing Figures

THREAD END HOLDER FOR SEWING MACHINE

BACKGROUND AND SUMMARY OF THE INVENTION

The invention relates to an apparatus and method for holding a thread end left in a needle of a sewing machine after completion of a sewing operation.

At the end of many sewing operations, in particular sewing a buttonhole in a fabric with a conventional automatic sewing machine, a few inches of thread end are pulled from the needle. In industrial-type sewing where operations must be repeated at maximum efficiency, this thread end frequently is sewn into the next buttonhole to leave a long and unsightly thread dangling from that button.

Several devices have been developed and used in the past in order to prevent this thread end from being left dangling. One technique is to provide a trimmer for cutting the thread end at the end of the operation. This, however, involves an additional step by the operator and an additional piece of equipment. Another approach is to use a mechanical wiper to automatically knock the thread to the side after the completion of each operation. So long as the thread end is held away from the needle the thread will simply double in the next operation and will not dangle from the sewn buttonhole. Such wipers, however, have never worked satisfactorily.

Yet another technique which has been proposed is to knock the thread end to the side by the use of a burst of air from a blower. This technique likewise has not been completely satisfactory.

The present invention relates to a unique apparatus and method in which between sewing operations, the thread end is drawn into a tube adjacent the needle of the sewing machine by air flow into that tube. The thread end is thus held away from the needle and will simply be doubled in the next sewing operation. Providing air flow only between operations minimizes the use of supply air.

In a preferred embodiment of the invention, the air flow into the tube adjacent the needle is caused by transfer of momentum from a stream of supply air at a pressure above atmospheric pressure to air flowing through an aspirator having a passage coupled to the tube. A normally opened or normally closed valve is operated by a part of the sewing machine, for example, one of the levers, to enable the flow of air to the aspirator only between operations of the sewing machine. The tube is preferably attached at one end thereof to a foot of the sewing machine and at its other end to the aspirator mounted on the machine by a bracket or the like.

Many other objects and purposes of the invention will be clear from the following detailed descriptions of the drawings.

DETAILED DESCRIPTION OF THE INVENTION

Figure 1:
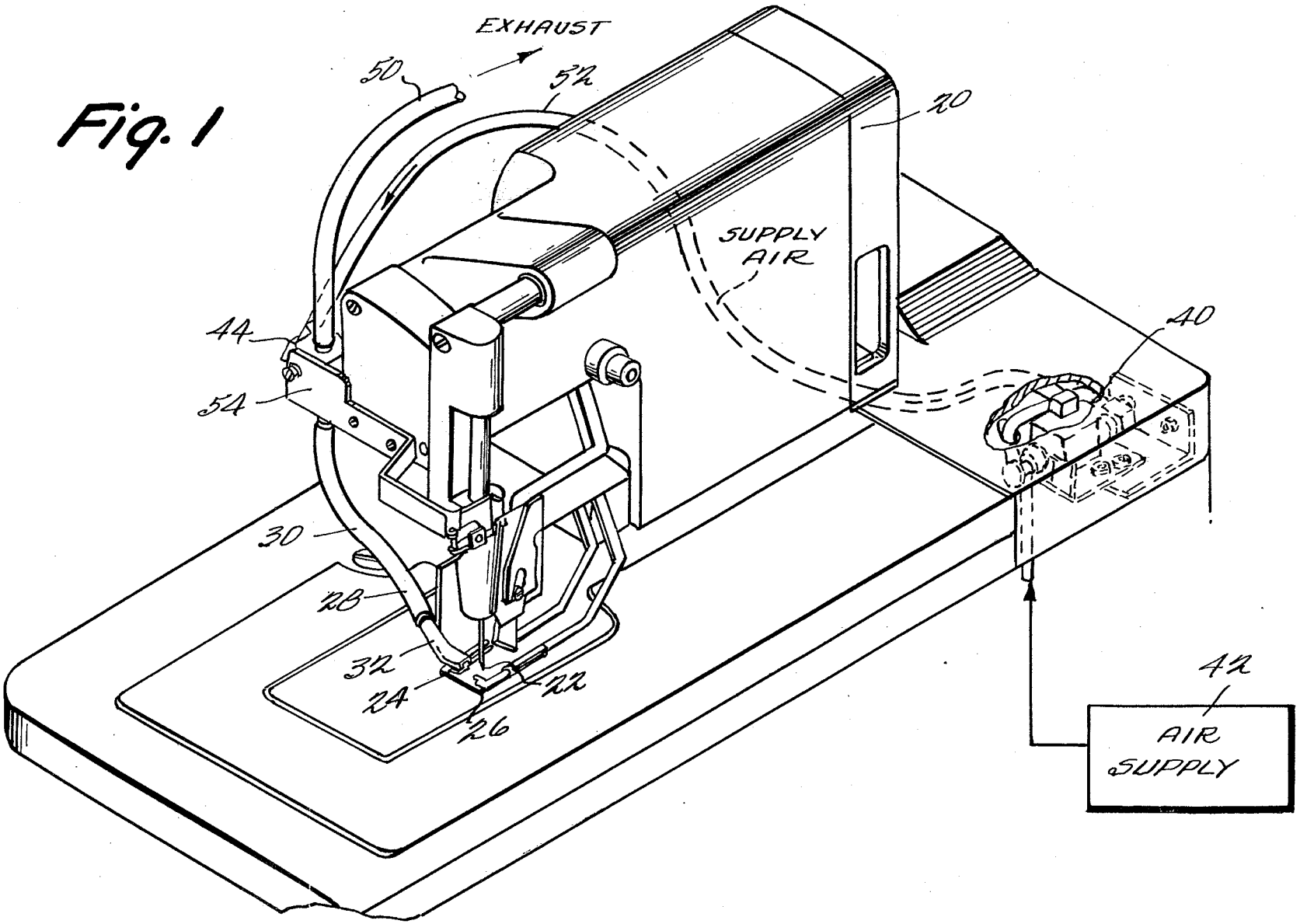
FIG. 1 shows a first embodiment of an apparatus of this invention on a conventional buttonhole sewing machine.

Reference is now made to FIG. 1 which shows a perspective view of one model of a sewing machine 20 having a needle 22 which is oscillated in a conventional manner to sew thread for example, to sew a buttonhole in a piece of fabric. Feet 24 and 26 are conventionally provided adjacent to the sewing machine. The present invention can be used in conjunction with any conventional type of sewing machine and indeed can be used in conjunction with other similar type equipment. It will be understood that various modifications of the mounting brackets and valves may be required in order for the invention to be efficiently and effectively used with different models of machines.

Tube 28 comprises a flexible hose 30 and a rigid member 32 with the rigid member 32 defining an opening of tube 28 adjacent to the needle 22. More particularly, rigid member 32 is suspended adjacent needle 22. Between sewing operations air flows into the opening of rigid member 32 so that a thread end is drawn into member 32 and the thread will then be doubled during the next sewing operation.

Figure 2:
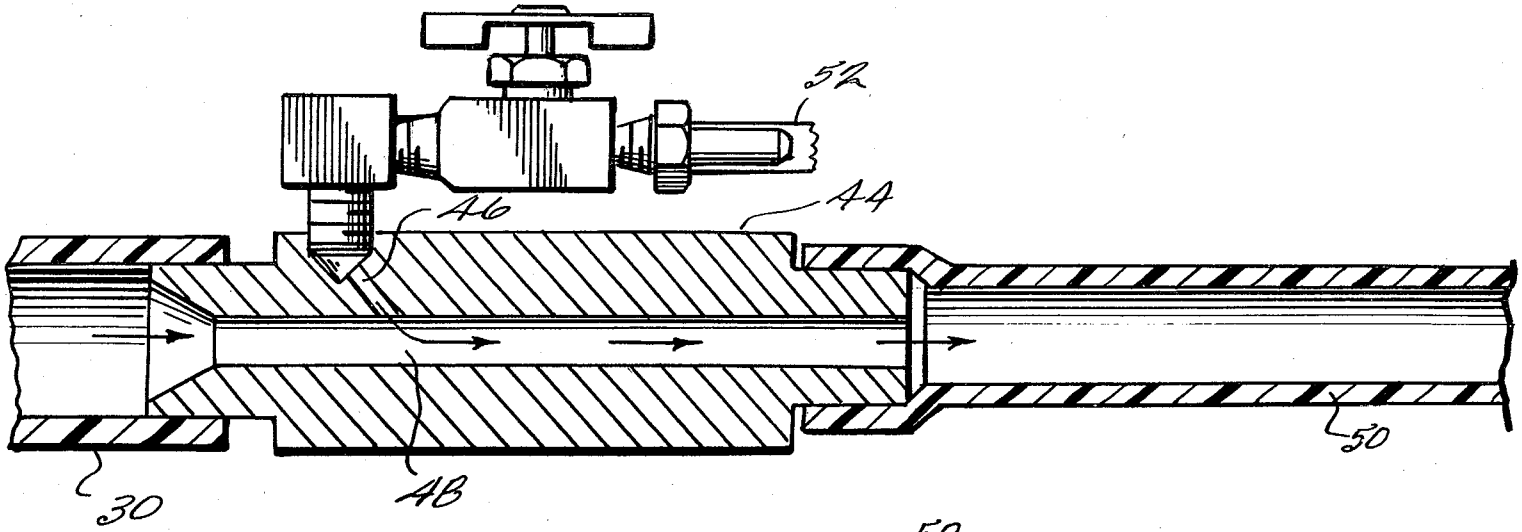
FIG. 2 shows a sectional view of an aspirator of the apparatus.

A conventional valve 40 connects a schematically indicated supply 42 of air under pressure to an aspirator 44 which is shown in detail in FIG. 2. The pressurized air is directed through a bore 46 constituting an orifice in communication with a passage 48 in the aspirator to transfer momentum to the air in that passage and thus create a vacuum causing the air to flow into the opening of tube 28. Manual valves can be used to turn off air flow. Bore 46 directs air into passage 48 at an acute angle to the longitudinal axis of the passage (see FIG. 2). Similar momentum-type aspirators have been sold for several years and are described further, for example, in U.S. Pat. No. 3,968,538, the disclosure of which is incorporated herein by reference. The air passing out of the passage 48 is conducted by flexible line 50 to any suitable location. The supply line 52 connects conventional valve 40 in FIG. 1 to the bore 46 of aspirator 44. In FIG. 1, bracket 54 attaches aspirator 44 directly to the sewing machine, and it will be understood that different brackets to attach the aspirator at different locations would normally be used for different models of machines.

Figure 3:
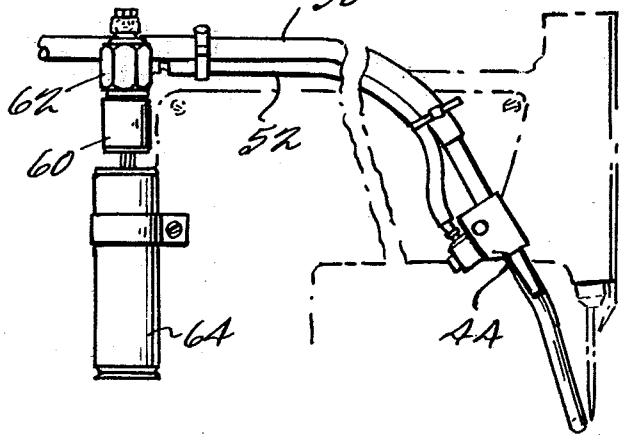
FIG. 3 shows an elevational view of the impulse valve assembly in accordance with a second embodiment of the apparatus of this invention.

In accordance with another feature of the present invention, to shut off air between operations, a pulse valve assembly 60 may be inserted in supply line 52 as is illustrated in FIG. 3. Pulse valve assembly 60 includes a conventional pulse valve 62 having an input which may be connected to valve 40 and an output which may be connected to orifice 46 in aspirator 44. Valve 40 would suitably comprise a three-way valve mechanically responsive to the operation of the stop motion of the sewing machine. A storage tank or accumulator 64 is fitted to pulse valve 62 in order to lengthen the duration of pulses generated through valve 62. A flow control valve may be mounted to the bottom of tank 64 in order that the pulse duration may be varied.

Many other changes and modifications in the above-described embodiment of the invention can, of course, be carried out without departing from the scope thereof. Accordingly, that scope is intended to be limited only by the scope of the appended claims.

What is claimed is:

1. An apparatus adapted for mounting on a sewing machine for holding a thread end left in the needle after completion of a sewing operation, comprising:

a tube having an opening at one end adapted to be positioned adjacent the needle of the sewing machine;

means connected to said tube for causing air flow into said opening to draw said thread end into said tube;

means operable in response to cessation of operation of the sewing machine for activating the causing means to draw said thread end into the tube; and means for deactivating said causing means after a predetermined period of time, the thread end remaining in the tube until operation of the sewing machine is resumed.

2. An apparatus as in claim 1, wherein said causing means comprises a source of air under pressure, and an aspirator having a passage therein in communication with the other end of said tube, and an orifice in communication with the source of air under pressure for directing pressurized air into said passage at an acute angle to the longitudinal axis thereof for creating a vacuum in the passage drawing air through said tube.

3. An apparatus as in claim 2, further comprising a supply line connecting the source of air under pressure and the aspirator, said activating means comprising valve means in said line, said valve means opening to enable the flow of pressurized air to said passage in the aspirator only when said sewing machine is not in operation.

4. An apparatus as in claim 2 further including an exhaust line connected to said aspirator, said exhaust line receiving said pressurized air and said air flowing in the tube.

5. An apparatus as in claim 2, further including means for mounting said aspirator on said machine.

6. An apparatus adapted for mounting on a sewing machine for holding a thread end, comprising;

a tube having an opening at one end adapted to be positioned adjacent the needle of a sewing machine; and means connected to said tube for causing air flow into said opening to draw said thread end into said tube;

the tube including a flexible hose and a rigid member adapted to be attached to a foot of said machine.

7. A method of operating a sewing machine, comprising the steps of:

performing a sewing operation leaving a thread end at the needle at the completion of the sewing operation;

causing air flow into a tube adjacent said needle to draw the thread end into said tube at the cessation of the operation of the sewing machine;

and terminating the flow of air into the tube after a predetermined period of time, the thread end remaining in the tube until initiation of the next sewing operation.

8. A method as in claim 7 wherein said step of causing air flow through the tube includes the step of delivering air under pressure to a passage in an aspirator in communication with the tube to create a vacuum in said passage causing said air flow into said tube.

9. A method as in claim 8, wherein said sewing operation includes sewing of a buttonhole in fabric.

10. In combination:

a sewing machine having a needle for sewing thread, the end of said thread being left in the needle after completion of a sewing operation;

means for holding said thread end between sewing operations comprising a tube having an opening adjacent said needle, and means for causing air flow into said tube so that said thread end is drawn into said tube;

means operable in response to cessation of the operation of the sewing machine for activating the causing means to draw said thread end into the tube; and means for deactivating said causing means after a predetermined period of time, the thread end remaining in the tube until operation of the sewing machine is resumed.

11. In combination as in claim 10, including means for mounting said tube and said causing means on said machine.

12. An apparatus as in claim 3 wherein said deactivating means comprises a pulse valve in said line between the aspirator and the valve means, said pulse valve opening to enable the flow of pressurized air from the source thereof via the valve means to the aspirator for said predetermined period of time.

13. An apparatus as in claim 12 wherein the deactivating means further comprises an adjustable air accumulator for varying the period of time during which the pulse valve is open and thus the period of time during which pressurized air flows to the aspirator.

14. An apparatus as in claim 10 wherein said causing means comprises a source of air under pressure, and an aspirator having a passage therein in communication with the other end of said tube, and an orifice in communication with the source of air under pressure for directing pressurized air into said passage at an acute angle to the longitudinal axis thereof for creating a vacuum in the passage causing said air flow into said tube.

15. In combination as in claim 14 including a supply line connecting the source of air under pressure and the aspirator, said activating means comprising valve means in said line, said valve means opening to enable flow of air under pressure to said causing means only between sewing operations.

16. In combination:

a sewing machine having a needle for sewing thread, the end of said thread being left after completion of a sewing operation;

means for holding said thread between sewing operations including a tube having an opening adjacent said needle, and means for causing air flow into said tube so that said thread end is drawn into said tube;

said tube including a flexible hose connected at one end to said causing means and a rigid member connected at one end to the other end of said hose and defining said opening at the other end and including means for attaching said rigid member to a foot of said machine.

* * * * *